United States Patent [19]

Helfman

[11] 4,376,353

[45] Mar. 15, 1983

[54] BUILDING STRUCTURE

[76] Inventor: Charles Helfman, 19533 W. 7 Mile Rd., Detroit, Mich. 48219

[21] Appl. No.: 204,219

[22] Filed: Nov. 5, 1980

[51] Int. Cl.[3] ..... E06B 1/04

[52] U.S. Cl. ..... 49/504

[58] Field of Search ..... 49/504, 380, 470, 400, 49/383

[56] References Cited

U.S. PATENT DOCUMENTS

| | | | |
|---|---|---|---|
| 3,426,479 | 2/1969 | Rease, Jr. | 49/504 X |
| 3,634,962 | 1/1972 | Peterson | 49/380 X |
| 4,106,238 | 8/1978 | Bonello | 49/504 X |
| 4,236,354 | 12/1980 | Passovoy | 49/504 |

*Primary Examiner*—Kenneth Downey

*Attorney, Agent, or Firm*—Barnes, Kisselle, Raisch, Choate, Whittemore & Hulbert

[57] ABSTRACT

Composite wood and metal building structure including a metal angle iron frame having an integral latch strike and dead bolt recess therein and a wood door hingedly secured within the frame for installation together therewith in a building opening, with one leg of the angle iron frame extending transversely of the door about the edges thereof and with the other leg of the angle iron door frame extending substantially in the plane of the door about the periphery of a building structure opening.

4 Claims, 5 Drawing Figures

BUILDING STRUCTURE

BACKGROUND OF THE INVENTION

1. Field of the Invention

The invention relates to doors and refers more specifically to a composite wood and metal door structure including a metal frame adapted to be secured around the inside periphery of an opening in a building structure and a wood door secured within the metal frame, whereby removal of the wood door by disengagement of its attachment to the building structure at the opening in the building structure is prevented.

2. Description of the Prior Art

In the past, in home and apartment construction and the like, wood doors have generally been secured to wood frames around the periphery of building openings. Thus, wood doors of the past have generally been secured as by hinge screws and the like to wood frame or trim members positioned in the building openings. Similarly, latches and locks for such doors have generally engaged separate metal strikes and recesses defined by separate metal members.

With such structure, entry through the building opening has often been possible by dislodging the door or strikes or separate metal members from the frame or trim members about the door opening, as by strongly pulling on the door from the exterior thereof, to remove the entire door and whatever elements the door is secured to from the door opening. Such structure is not suitable in many high crime locations where there is fear of breaking and entering through the door opening. However, previous alternatives such as complete metal door structure fabrications have been expensive and often aesthetically undesirable.

SUMMARY OF THE INVENTION

In accordance with the present invention, a composite door structure is provided which greatly reduces the possibility of breaking and entering and yet is aesthetically pleasing and reasonable in cost.

The composite building structure, in accordance with the invention, includes a metal frame which has angle iron jambs and head and a metal door sill, which frame is positioned in a door opening from the inside thereof in combination with a wood door secured within the metal frame for shipment and installation therewith.

In accordance with the invention, normal jambs and trim are suitable for use with the composite metal frame and wood door structure, whereby the appearance of the structure of the invention is little different than the usual wood trim and wood door construction. Further, the composite metal frame and wood door structure of the invention may be utilized in existing structures without removal of existing trim.

In particular, the jambs and head of the metal frame have leg portions which extend transversely of the door opening about the inner periphery thereof and leg portions which extend substantially in the plane of the door around the inner periphery of the door opening which are secured to the building structure around the building opening, whereby the frame and therefore the door secured to the frame is reliably secured in the opening in the building structure.

DESCRIPTION OF THE PREFERRED EMBODIMENT

Figure 1:
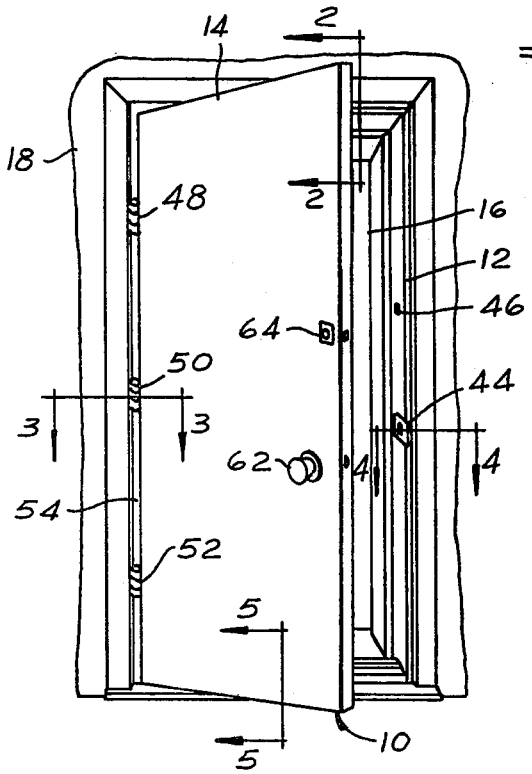
FIG. 1 is a perspective view of a composite metal frame and wood door structure installed in an opening in a building structure, showing the wood door of the composite structure in an open position.

The composite door structure 10 of the invention includes a metal frame 12 and a wood door 14. The door structure 10 as shown best in FIG. 1 is secured in an opening 16 in a building structure 18.

Figure 2:
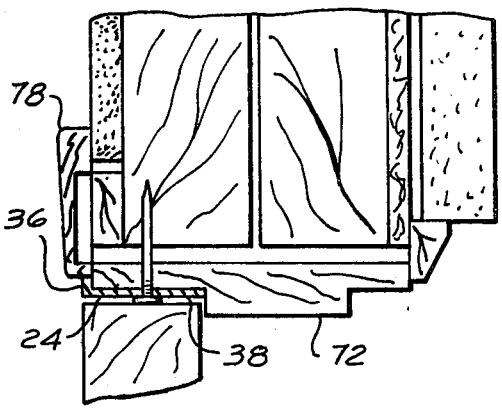
FIG. 2 is an enlarged partial cross section of the structure illustrated in FIG. 1, taken substantially on the line 2—2 with the door closed.
Figure 3:
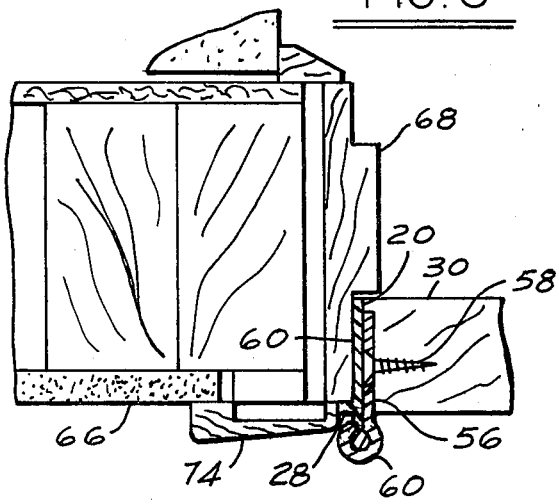
FIG. 3 is an enlarged partial cross section of the structure illustrated in FIG. 1, taken substantially on the line 3—3 with the door closed.
Figure 4:
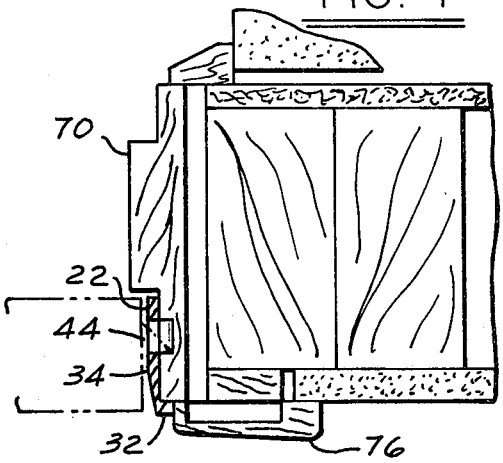
FIG. 4 is an enlarged partial cross section of the structure illustrated in FIG. 1, taken substantially on the line 4—4 with the door closed.

More specifically, the metal frame 12 has a hinge side jamb member 20, a lock side jamb member 22, a head member 24, and a sill 26. The jamb members 20 and 22 and the head member 24 as shown best in FIGS. 2–4 are angle irons which may for example be ⅜ inch thick, and have leg portions 28 and 30, 32 and 34, and 36 and 38, respectively. The sill member 26 has a cross section as shown best in FIG. 5. The frame members 20, 22, 24 and 26 may be connected together at their ends by convenient means such as welding and/or brackets and/or screws, as desired.

A latch strike 44 is provided integral with the L-shaped lock side door frame member 22 in the leg 34 thereof as shown best in FIG. 4.

A dead bolt retaining opening or recess 46 is also provided in the leg 34 of the lock side door frame member 22 as shown in FIG. 1.

Figure 5:
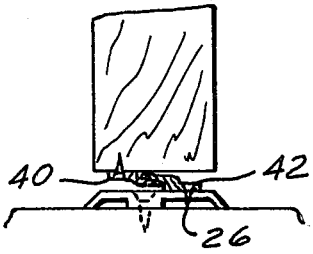
FIG. 5 is an enlarged partial cross section of the structure illustrated in FIG. 1, taken substantially on the line 5—5 with the door closed.

Cooperating weatherstrip members 40 and 42 are secured to the bottom of the door 14 and the top of the sill 26 as shown best in FIG. 5.

The door 14 is wood and is secured to the metal frame 12 through hinges 48, 50 and 52 in spaced apart location along the edge 54 of the door 14. One leaf of each hinge such as leaf 56 of hinge 50, as shown in FIG. 3, is secured to the door 14 by convenient means such as screws 58. The other leaf of the hinges 48, 50 and 52, including hinge portions 60 as shown in FIG. 3, are integral with and part of the leg 30 of the hinge side angle iron door frame jamb member 20.

The door 14 further has the normal door knob and latch structure 62 and dead bolt structure 64 in conjunction therewith mating with the latch strike 44 and dead bolt recess 46 in the door frame jamb member 22 whereby the lock edge of the wood door 14 may be secured in the metal frame 12.

In accordance with the invention, the composite metal frame 12 and wood door 14 are produced and installed as a unit in the building opening 16.

In such installation, as best shown in FIGS. 2–4, the short legs 28, 32 and 38 of the angle iron frame 12 which may be ¼ inch, for example, are positioned against the inner surface of the building structure 18 around the periphery of the building opening 16 so that they extend over the building structure.

The legs 30, 34 and 38 of the angle iron members of the metal frame 12 extend transversely of the door opening 16 and are positioned flush against the door jamb members 68 and 70 and the head member 72, as shown and are nailed in place approximately ¾ inch from the ends thereof, for example. Installation in new construction is then completed by installing the usual trim members 74, 76 and 78 on the interior of the opening 16 of the building structure 18, again as shown best in FIGS. 2–4. In existing construction, the trim members 74, 76 and 78 are already in place and the short legs 28, 32 and 38 of the frame 12 permit installation of the frame 12 without removal of the trim.

Thus it will be seen that with the composite metal and wood door structure of the invention, a wood door may be provided in a building opening which has substantially the ability of metal door structures to resist removal of the door structure from the outside of a building opening by means of pulling the door structure through the building opening, but which has the additional advantage of being relatively inexpensive in construction and has the aesthetics of wood door construction.

Further, it will be noted that the composite metal frame and wood door structure disclosed may be utilized either in new construction or may be advantageously used in remodeling older construction to provide additional security therein, since installation of the composite metal frame and wood door structure does not require the removal of the inside trim members 74, 76 and 78 of old construction.

While one embodiment of the present invention has been disclosed in detail herein, it will be understood that other embodiments and modifications thereof are contemplated. It is the intention to include all such embodiments and modifications as are defined by the appended claims within the scope of the invention.

I claim:

1. Building structure comprising an opening in a building, door jambs at the opposite sides of the opening and a head member at the top of the opening in the building structure, a metal frame positioned in the opening in engagement with the door jambs and head member including angle iron vertically extending jamb members and an angle iron horizontally extending head member and a metal door sill extending between the angle iron frame jamb members at the bottom thereof, said metal frame being positioned on the inside of the opening with one short leg of the angle iron members thereof being approximately ¼ inch long and extending substantially in the plane of the opening on the inside thereof and terminating at interior trim around the opening in the building and the other, longer leg of the angle iron members extending transversely into the opening toward the outside thereof, means securing the metal frame to the building structure about the opening, and a wood door secured to the metal frame for installation with the metal frame.

2. Structure as set forth in claim 1, wherein the angle iron jamb member of the metal frame at one edge of the door includes an integral strike plate.

3. Structure as set forth in claim 1 and further including an opening for receiving a dead bolt in the angle iron jamb member of the metal frame at one edge of the door.

4. Structure as set forth in claim 1, wherein the angle iron jamb member of the metal frame at one edge of the door includes integral hinge leafs spaced vertically therealong.

* * * * *